US005538533A

United States Patent [19]

Alexander et al.

[11] Patent Number: 5,538,533

[45] Date of Patent: Jul. 23, 1996

[54] ALUMINA-BASED CERAMIC COMPOSITE

[75] Inventors: Kathleen B. Alexander, Oak Ridge; Terry N. Tiegs, Lenoir City; Paul F. Becher, Oak Ridge; Shirley B. Waters, Knoxville, all of Tenn.

[73] Assignee: Martin Marietta Energy Systems, Inc., Oak Ridge, Tenn.

[21] Appl. No.: 498,417

[22] Filed: Sep. 11, 1995

Related U.S. Application Data

[62] Division of Ser. No. 250,266, May 27, 1994, Pat. No. 5,482,673.

[51] Int. Cl.$^6$ ..... C22C 29/12

[52] U.S. Cl. ..... 75/235; 75/236

[58] Field of Search ..... 75/235, 236, 249

[56] References Cited

U.S. PATENT DOCUMENTS

| | | | |
|---|---|---|---|
| 4,689,077 | 8/1987 | Chevigne et al. | 75/233 |
| 4,749,545 | 6/1988 | Begg et al. | 419/13 |
| 4,919,718 | 4/1990 | Tiegs et al. | 75/232 |
| 5,015,290 | 5/1991 | Tiegs et al. | 75/232 |
| 5,089,047 | 2/1992 | Buljan et al. | 75/236 |
| 5,271,758 | 12/1993 | Buljan et al. | 75/232 |
| 5,279,191 | 1/1994 | Buljan et al. | 82/1.11 |

OTHER PUBLICATIONS

W. H. Tuan and R. J. Brook, "the Toughening of Alumina with Nickel Inclusions", Jl. of the European Ceramic Society 6 (1990) 31–37.

W. H. Tuan and R. J. Brook, "Processing of Alumina/Nickel Composites", Jl. of the European Ceramic Society 10 (1992) 995–1000.

J. Mostaghaci, "Fabrication of Cermets from Alumina and Ni–based Alloys", Ceramics Transactions, vol. 12, Ceramic Powder Science III, G.L. Messing, S. Hirano, and H. Hausner (Eds). Am. Ceramic. Soc.(1990).

R. A. Cutler, A. C. Huford, and A. V. Virkar, "Pressuseless–Sintered $Al_2O_3$–TiC Composites", Mat. Sci. and Eng. A105/106 (1988) 183–192.

E. Breval, Z. Deng, S. Chisu, C. G. Pantano, "Sol–gel prepared Ni–alumina composite materials," Jl. of Mat. Sci. 27 (1992) 1464–1468.

R. P. Wahi, and B. Ilschner, "Fracture behavior of composites based on $Al_2O_3$–TiC", Jl. of Mat. Sci., 15 (1980) 875–885.

M. Lee and M. P. Borom, "Raynd Rate Sintering of $Al_2O_3$–TiC composites for Cutting Tool Applications", Adv. Ceram. Mat. 3 (1) (1988) 38–44.

T. Ekstrom, "Alumina Ceramic with Particle Indusions", Jl. of the European Ceram. Soc., 12 (1993) 487–496.

*Primary Examiner*—Ngoclan Mai

*Attorney, Agent, or Firm*—I. L. Ericson; J. D. Griffin; H. W. Adams

[57] ABSTRACT

An improved ceramic composite comprising oxide ceramic particulates, nonoxide ceramic particulates selected from the group consisting of carbides, borides, nitrides of silicon and transition metals and mixtures thereof, and a ductile binder selected from the group consisting of metallic, intermetallic alloys and mixtures thereof is described. The ceramic composite is made by blending powders of the ceramic particulates and the ductile to form a mixture and consolidating the mixture of under conditions of temperature and pressure sufficient to produce a densified ceramic composite.

2 Claims, 4 Drawing Sheets

Fig.4
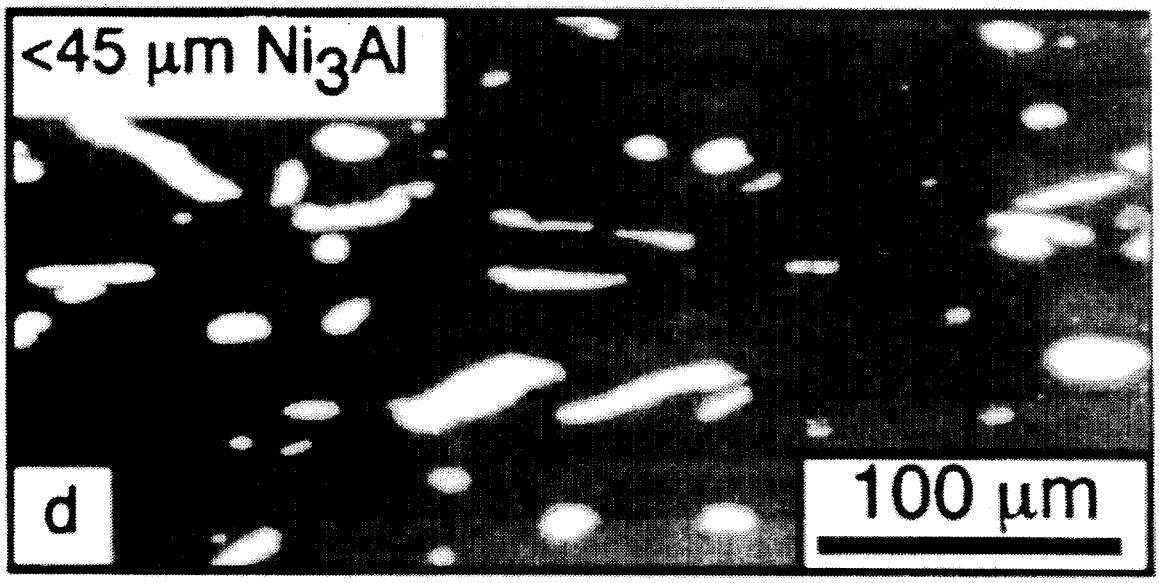
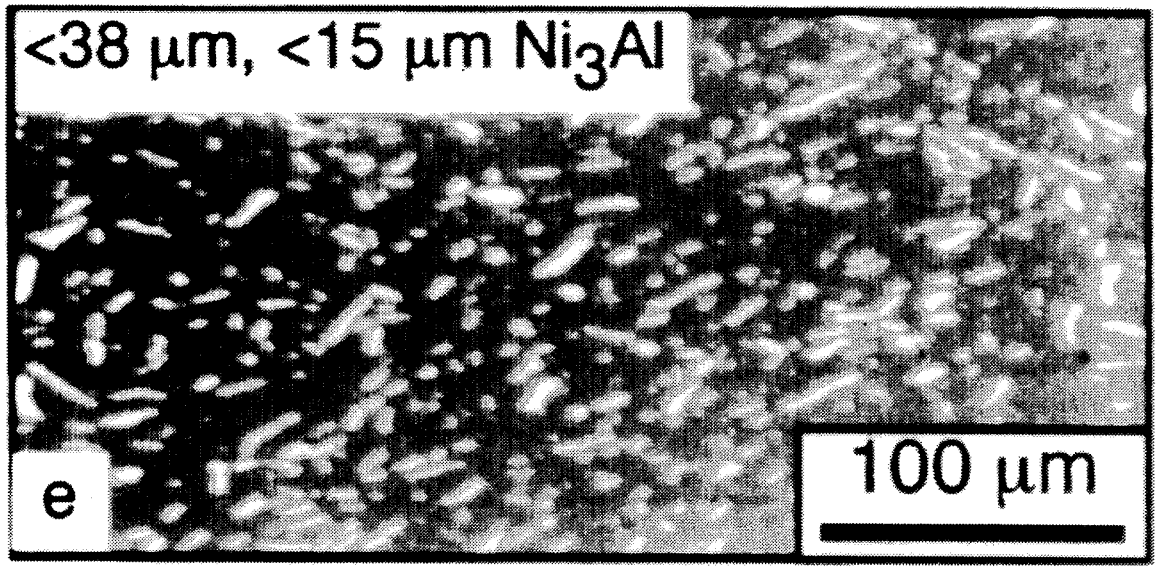
Fig.5

ALUMINA-BASED CERAMIC COMPOSITE

This invention was made with Government support under contract DE-AC05-84OR21400 awarded by the U.S. Department of Energy to Martin Marietta Energy Systems, Inc. and the Government has certain rights in this Invention.

This application is a division of application No. 08/250,266, filed May 27, 1994 U.S. Pat. No. 5,482,673.

FIELD OF THE INVENTION

The present invention relates to a ceramic composite more particularly, a ceramic composite containing a ductile binder.

BACKGROUND OF THE INVENTION

Currently available alumina-based composites with high hardness, toughness, and strength which are intended for use at both ambient and elevated temperature applications are either expensive (silicon carbide-whisker reinforced alumina) or have limited toughness, typically considerable less than 5 $MPam^{1/2}$ (alumina with particulate second phase additions of titanium carbide, silicon carbide, boron carbide, etc.)

U.S. Pat. Nos. 4,919,718 and 5,015,290 pertaining to "Ductile $Ni_3Al$ alloys as bonding agents for ceramic materials", and "Ductile $Ni_3Al$ alloys as bonding agents for ceramic materials in Cutting Tools" described the use of nickel aluminide and other intermetallic alloys as additions to carbide, nitride, or oxide ceramics.

In a paper by T. Ekstrom, "Alumina Ceramics with Particle Inclusions", Jl. of the European Ceram. Soc., 12 (1993) 487–496, Ekstrom describes an alumina-based composite containing up to 30 wt. % Ti(C,N) and up to 5 wt. % nickel or nickel-molybdenum alloy additions. The composites were pressureless-sintered at 1750° C. and hot-isostatically pressed at 1660° C. with 200 MPa applied pressure.

In a paper by H. Mostaghaci, "Fabrication of Ceramics from Alumina and Ni-Based Alloys", Ceramics Transactions, Vol. 12, Ceramic Powder Science III, G. L. Messing, S. Hirano, and H. Hausner (eds.) Am. Ceram. Soc. (1990), the investigator describes alumina-based composites which were fabricated with the use of nickel alloys containing TiC additions. In this case, the investigator fabricated composites containing up to 25 vol % metallic content by pressureless sintering. No mechanical properties were reported, however, the TiC content (2.5 vol %) is probably not sufficient to retain high hardness.

OBJECTS OF THE INVENTION

Accordingly, it is an object of the present invention to provide an ceramic composite having a high toughness, hardness, and flexural strength. Further and other objects of the present invention will become apparent from the description contained herein.

SUMMARY OF THE INVENTION

In accordance with one aspect of the present invention, a new and improved ceramic composite comprises oxide ceramic particulates, nonoxide ceramic particulates selected from the group consisting of carbides, carbonitrides, borides, nitrides of silicon and transition metals, and mixtures thereof, and a ductile binder selected from the group consisting of metallic, intermetallic alloys and mixtures thereof.

In accordance with another aspect of the present invention, a new and improved article of manufacture comprises alumina ceramic particulates, nonoxide ceramic particulates selected from the group consisting of carbides, borides, nitrides of silicon and transition metals and mixtures thereof, and a ductile binder selected from the group consisting of metallic, intermetallic alloys and mixtures thereof. The article has a density greater than 85% of theoretical density and is in a dense, rigid form.

In accordance with another aspect of the present invention, a new and improved process for the preparation of a ceramic composite comprising oxide ceramic particulates, nonoxide ceramic particulates selected from the group consisting of carbides, carbonitrides, borides, nitrides of silicon and transition metals, and mixtures thereof, and a ductile binder selected from the group consisting of metallic, intermetallic alloys and mixtures thereof comprises blending powders of the oxide ceramic particulates, the nonoxide ceramic particulates and the ductile binder to form a mixture; and consolidating the mixture under a temperature and pressure sufficient to produce a densified ceramic composite.

BRIEF DESCRIPTION OF THE DRAWINGS

In the drawings:

FIG. 4 is a microphotograph of composites of 90 vol % $Al_2O_3$/10 vol % $Ni_3Al$ fabricated using $Ni_3Al$ powder having a particle size of <45 μm.

FIG. 5 is a microphotograph of composites of 90 vol % $Al_2O_3$/10 vol % $Ni_3Al$ fabricated using $Ni_3Al$ powder having a particle size of <38 μm, >15 μm.

Figure 1:
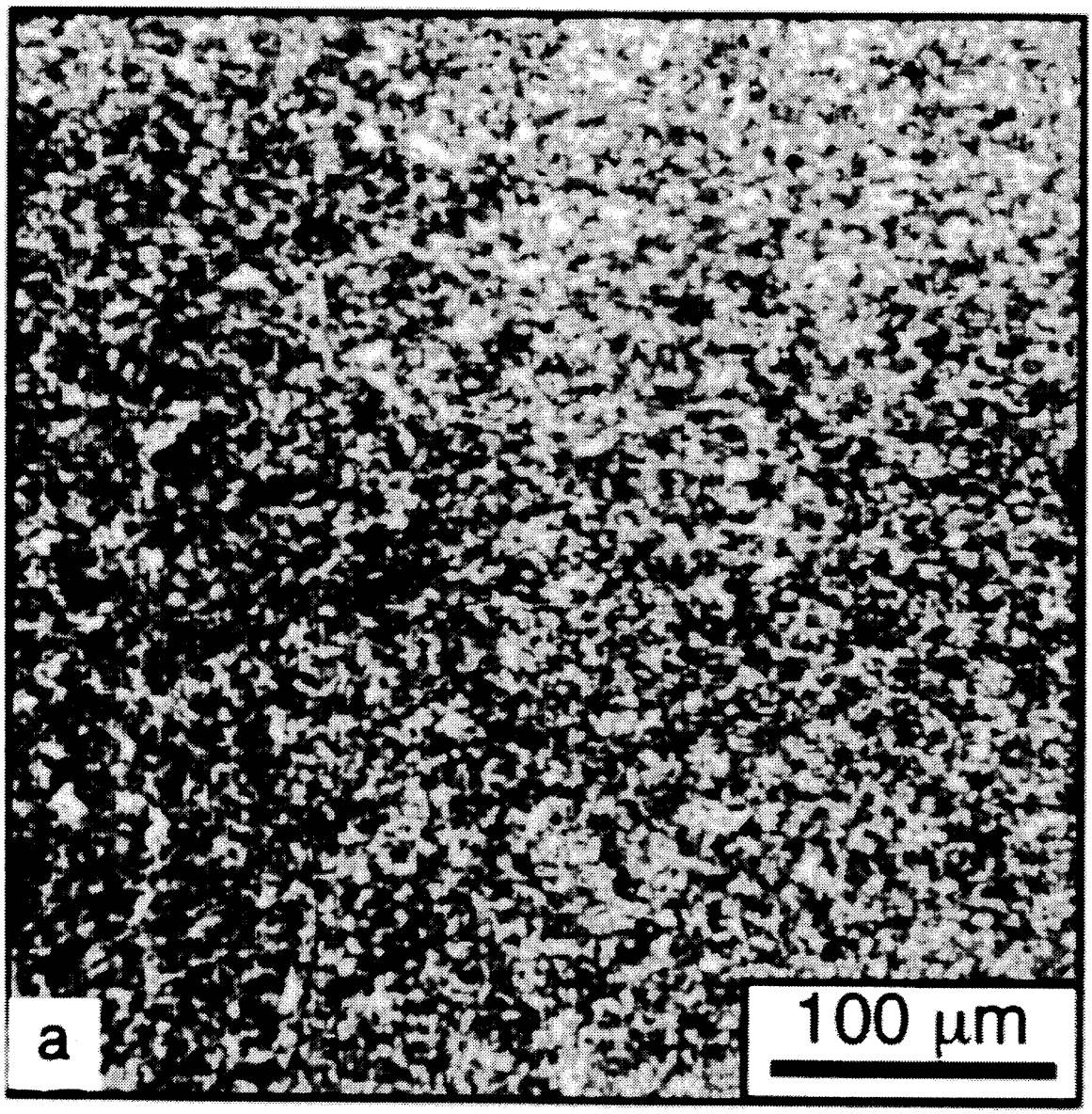
FIG. 1 is a microphotograph of $Al_2O_3$—TiC—$Ni_3Al$ composite fabricated with 3.0 82 m TiC powder in accordance with the present invention.

For a better understanding of the present invention, together with other and further objects, advantages and capabilities thereof, reference is made to the following disclosure and appended claims in connection with the above-described drawings.

DETAILED DESCRIPTION OF THE PREFERRED EMBODIMENTS

The ceramic composite of this invention is a low-cost, ceramic composite with high toughness, hardness, and flexural strength. In addition, the composite is fabricated from components which permit lower processing temperatures compared to reinforced alumina-based composites such as $Al_2O_3$/TiC and $Al_2O_3$/SiC-whiskers. Ductile intermetallic alloy additions were used due to their high yield strength and high temperature stability. It has been shown that by suitable alloying additions, $Ni_3Al$ alloys can exhibit elongation up to 40%. The plastic deformation of the $Ni_3Al$ alloys can thus act as a potent mechanism for increasing the fracture toughness of ceramic composites. Furthermore, intermetallic alloy properties relevant to the toughening behavior, such as the yield strength, can be tailored by alloying additions.

The composites prepared by Ekstrom were pressureless-sintered at 1750° C. and hot-isostatically pressed at 1660° C. with 200 MPa applied pressure; rather than hot-pressed at the lower temperatures described in the present invention. With 30 wt. % Ti(C,N) and 5 wt. % metal additions, a hardness of 18 GPa and a fracture toughness of about 5

$MPam^{1/2}$ are observed. In addition, the nickel additions used in this work will not perform in a comparable manner to nickel aluminide additions, since ductile nickel aluminide alloys exhibit both higher yield strengths and higher temperature capabilities than nickel alloys. The work did not anticipate the use of ductile intermetallic alloys to further improve fracture toughness of the composite. The work also was limited to binder phase additions of less than 5 wt % (2.5 vol %). In addition, the study was limited to only Ti(C,N) additions.

The hardness for alumina containing nickel aluminide described in U.S. Pat. Nos. 4,919,718 and 5,015,290 is substantially less than that obtained in the composites of the present invention described herein. In addition, the theoretical densities of the composites of the present invention described herein are substantially less (4.4 vs. 5.7 $g/cm^3$) than those observed in the $Ni_3Al$/TiC composites described in the patents above. In addition, the patents do not anticipate an improvement in wetting between oxide ceramics with additions of TiC (or other carbide, nitrides, or carbonitrides). Also the patents did not anticipate the use of TiC to recover some of the hardness lost due to the nickel aluminide additions. The ceramic composites of the present invention therefore, represent a unique and substantial improvement over the results in the aforementioned patents as well as over the commercially available $Al_2O_3$/TiC composites currently used commercially.

In the work done by H. Mostaghaci there was no anticipation of any significant improvement in mechanical properties by the combination of $Al_2O_3$/TiC and intermetallic alloys as was accomplished by the present invention.

In the ceramic composites of the present invention, the components consist of oxide ceramic particulates, non-oxide ceramic particulates, and a ductile alloy binder. The oxide particles generally have poor wetting characteristics with the binder phases but provide good thermal stability characteristics and relatively low theoretical density. The non-oxide particles improve the wetting between the ceramic particles and the alloy binder. They also generally increase the hardness. The ductile alloy acts as a binder between the ceramic particles and increases the toughness of the composite.

The preferred ductile binder is an intermetallic alloy comprising $Ni_3Al$. The ductile $Ni_3Al$ intermetallic binder can also contain sufficient boron to increase ductility.

The ductile binder content is from between about 0.5 vol % to about 50 vol % of said ceramic composite, preferably from about 5 vol % to about 15 vol % of said ceramic composite. The nonoxide particulates are from about 0.5 vol % to about 50 vol % of the ceramic composite, preferably from about 15 vol % to about 40 vol %.

An improved article of manufacture comprises alumina ceramic particulates, nonoxide ceramic particulates selected from the group consisting of carbides, borides, nitrides of silicon and transition metals and mixtures thereof, and a ductile binder selected from the group consisting of metallic, intermetallic alloys and mixtures thereof, said article having a theoretical density greater than 85% of theoretical density and being in a dense, rigid form.

The process for the preparation of the ceramic composite of the present invention comprises blending powders of the ceramic particulates and the ductile binder to form a mixture and consolidating the mixture under a temperature and pressure sufficient to produce a densified ceramic composite.

The following are specific examples of the present invention:

EXAMPLE 1

A sample containing 65 vol. % alumina, 25 vol. % TiC, and 10 vol. % commercially available IC50 $Ni_3Al$ was hot-pressed at 1550° C. for 90 min. with an applied pressure of 4 ksi. A density greater than 97% of theoretical density (4.57 $g/cm^3$) was obtained. The microstructures were isotropic. A fracture toughness of 8 MPa $m^{1/2}$, flexural strength of 550–600 MPa, and a microhardness of 25 GPa (HVO.1) were observed. A variety of compositions with 55–65 vol % alumina, 15–30 vol % TiC and 5–30 vol % $Ni_3Al$ have been fabricated by hot-pressing at 1550° C. The density in each case was in excess of >85% theoretical density.

EXAMPLE 2

A sample containing 65 vol. % alumina, 25 vol. % $TiB_2$, and 10 vol. % IC50 $Ni_3Al$ was hot-pressed at 1550° C. for 90 min. with an applied pressure of 4 ksi. A density greater than 96% of theoretical density was obtained.

EXAMPLE 3

A sample containing 65 vol. % alumina, 25 vol. % TiC and 10 vol. % nickel were hot-pressed at 1550° C. for 90 minutes with an applied pressure of 4 ksi. A density greater than 95% theoretical density was obtained.

EXAMPLE 4

Samples containing 90 vol. % alumina and 10 vol. % IC50 $Ni_3Al$ were hot-pressed at temperatures from 1350° C.–1550° C. for 90 minutes with an applied pressure of 5 ksi. The microstructure was anisotropic with elongated particles lying in the plane perpendicular to the hot-pressing direction. Since insufficient wetting behavior was observed, the $Ni_3Al$ was retained as a particulate phase that tended to form a disk-like shape oriented normal to the hot-pressing axis. As a result, fracture toughness up to 7–7.6 $MPam^{1/2}$ could be obtained with the crack propagating parallel to the hot-pressing axis. However, the crack growth resistance in the other directions were low, typically 4 MPa $m^{1/2}$. cl

EXAMPLE 5

Samples containing 90 vol. % TiC and approximately 10 vol. % $Ni_3Al$ (IC-396M) were hot-pressed at temperatures less than 1500° C. for 90 minutes with an applied pressure of 5 ksi. A density of 5.0 g/cm3, which is 95% of the theoretical density (5.26 $g/cm^3$) was obtained. A fracture toughness of 7 MPa $m^{1/2}$, flexural strength of 490 MPa and a hardness of 18 GPa (HV10) were observed.

Examples 1–3 above, the binder phase is isotropically distributed throughout the composite, despite the fact that the majority phase, alumina, is not itself wet by the binder phase. This desired microstructure results from carefully tailoring the size and volume-fractions of the constituent matrix phase, namely the oxide and nonoxide powder particles.

The design of these composites which incorporates three components: e.g.—alumina, titanium carbide and nickel aluminide, allows for (a) the development of the required microstructures for enhanced toughness, (b) the retention of the hardness with nickel aluminide additions, and (c) the achievement of very high toughness due to the combined effects of the titanium carbide and nickel aluminide additions.

Commercial $Al_2O_3$/TiC (>25 vol. % TiC) composites typically possess fracture toughness values no more than 3.5–4.5 MPa $m^{1/2}$, flexural strengths of 600–800 MPa, and a room temperature hardness of 25 GPa (HV0.1). The toughness increase (up to 8 MPa $m^{1/2}$) observed in the new composites relative to commercial $Al_2O_3$/TiC is substantial, and is accomplished without significant loss of hardness, while retaining flexural strengths greater than 500 MPa. The properties described in Example 1 above are comparable to those observed in alumina containing 10 vol. % SiC whiskers.

This approach can be used to fabricate alumina-based materials with a wide variety of ductile phase reinforcements. By carefully tailoring the distribution of the wetting, nonoxide particles in an alumina matrix, both metallic and intermetallic alloys can be isotropically distributed throughout the composite, with subsequent increases in toughening and/or hardness. By varying the amount of nonoxide particulates and ductile-phase reinforcements a wide range of toughness/hardness/strength properties can be obtained.

The combination of low cost and improved properties provided by these new composites makes these composites an attractive substitute for $Al_2O_3$/TiC and other toughened, hard oxide-based composites. These composites are appropriate for use in applications such as: cutting tools for paper, wood, stone, or metal; for use as wear or bearing surfaces; for use as knife blades in the paper and pulp industries, for substrates for flying heads in hard-disk drives, or as metal-forming dies such extrusion dies and compaction dies. The composite could also effectively be used as a metal/ceramic joint or as a functionally-gradient material.

Alternate oxide components include, but are not limited to: $ZrO_2$, $Y_2O_3$, $TiO_2$, $HfO_2$, MgO, $SiO_2$, glasses and mixtures thereof.

Alternate non-oxide components of carbides, carbonitrides, borides, nitrides of silicon and transition metals include, but are not limited to: Ti(C,N), SiC, $TiB_2$, $B_4C$, WC, ZrC, ZrN, $ZrB_2$, HfC, $W_2B_5$, TaC, NbC and mixtures thereof. The transition metals include Sc, Y, La, Ti, Zr, Hf, V, Cb, Ta, Cr, Mo, W, Mn, Tc, Re, Fe, Ru, Os, Co, Rh, Ir, Ni, Pd, Pt, Cu, Ag, and Au.

Alternate alloying additions include, but are not limited to: NiAl, $Fe_3Al$, FeAl, $MoSi_2$, $Ti_3Al$, TiAl, and mixtures thereof.

Composite fabrication can also be accomplished by using alternate procedures of consolidating the blended powders of oxide ceramic particulates, nonoxide ceramic particulates and a ductile binder such as pressureless sintering, hot-isostatic pressing, melt-infiltration, and reaction-synthesis.

The composites of the present invention can be made into articles of manufacture such as cutting tools and blades, bearings, metal/ceramic joints, and functionally-gradient materials, among other applications.

Mechanical properties critical to ceramic composite performance, such as fracture toughness, are substantially improved over similar, commercially available material such as $Al_2O_3$/TiC (8 versus 5 MPa $m^{1/2}$). In addition, the nickel aluminide alloys possess higher yield strength and higher temperature capability than the nickel-based additions described in Ekstrom's article and Mostaghaci's article referenced above.

The presence of nickel aluminide permits densification of $Al_2O_3$/TiC-based composites at lower processing temperatures.

The composites are simultaneously hardened and toughened. The addition of titanium carbide to alumina enhances and retains high hardness, whereas the nickel aluminide additions provide substantial toughening enhancement. U.S. Pat. Nos. 4,919,718 and 5,015,290 discuss composites consisting of a single ceramic component which is bonded and toughened by intermetallic alloy additions. The oxide-based composites described in those patents are anisotropic and have very limited flexural strength and lower hardness relative to those described in the present invention.

The use of a ductile material in a carefully tailored mixture of oxide ceramic particulates (non-wetting) and non-oxide ceramic particulates (wetting) produces isotropic composites possessing high fracture toughness, high hardness, and low density.

The preferred composition of the present invention is $Al_2O_3$—TiC—$Ni_3Al$.

Additions of ductile intermetallic alloys or metallic alloys to other particle-hardened oxide-based composites in the present invention are based on similar principles, in which the non-oxide additions serve to simultaneously harden the composite and facilitate the dispersion of the alloy via improved wetting. Several alternate compositions are discussed above.

The incorporation of metallic phases which plastically deform in the crack tip region, and thus dissipate strain energy will result in an increase in the fracture toughness of the composite as compared to a monolithic ceramic. The reinforced ceramic matrix composites of the present invention are capable of operating over a temperature range from 20° C. to 800°–1200° C. for advanced applications in the industrial sector.

Although nickel-aluminide reinforced alumina composites yielded significant increases in toughness compared to the fine-grained alumina matrix (7.8 v. 2.5 MPam$^{1/2}$), the hot-pressed composite microstructures providing the maximum toughness increases are anisotropic. In these composites, the interface between the nickel aluminide and the alumina debonds readily and substantial toughening is only achieved with highly oriented and elongated particles. An alternate means to achieve similar toughening would be to distribute the nickel aluminide in an interconnected and meandering manner, thus minimizing the ability of cracks to bypass the $Ni_3Al$ reinforcements. The ability to fabricate more isotropic and meandering microstructures depends for a large part on the wetting behavior of the nickel aluminide on the alumina. Approaches relying on alloying the nickel aluminide to achieve better wetting have been pursued and are described. Composites which utilized a combination of a wetting phase addition (TiC), $Ni_3Al$, and alumina to achieve the desired microstructural features were investigated. Composites were fabricated at temperatures above the nickel aluminide liquidus at a variety of pressures, as shown in Table I. The measured densities of the composites may not reflect the true density, since some of the $Ni_3Al$ can exude during hot-pressing. The microstructures of composites fabricated with 65 vol. % alumina, 10 vol. % $Ni_3Al$, and 25 vol. % coarse(3.0 μm) (FIG. 1) and fine(1.3 μm)(FIG. 2) TiC are shown in FIGS. 1–5. Also shown in FIGS. 1–5 are typical microstructures of alumina containing 10 vol. % $Ni_3Al$ reinforcements. The $Al_2O_3$/TiC/$Ni_3Al$ composites exhibit a much finer, more isotropic microstructure. It is clear that the presence of TiC allows the nickel aluminide to spread uniformly throughout the composite and form a very fine meandering distribution of nickel aluminide shown in FIG. 3. The measured harness, fracture toughness, and flexural strengths of selected composites is also shown in Table I. The TiC additions not only aid in the nickel aluminide redistribution, but also increase the hardness of the composite. The addition of 10 vol. % nickel aluminide to the $Al_2O_3$/TiC composite significantly increases the toughness relative to unreinforced $Al_2O_3$/TiC materials, which typically have a toughness of 3.5 to 4.5 MPam$^{1/2}$. In fact, the mechanical properties of these three-phase composites compare very favorably with $Al_2O_3/SiC_{whiskers}$ (10 vol. %) composites, however, the raw material costs of these new three-phase composites are significantly lower (Table II). In addition, the $Al_2O_3$/TiC/$Ni_3Al$ composites are hot-pressed at much lower temperatures and pressures than $Al_2O_3/SiC_{whiskers}$ (10 vol. %) composites offering further cost advantages.

Figure 2:
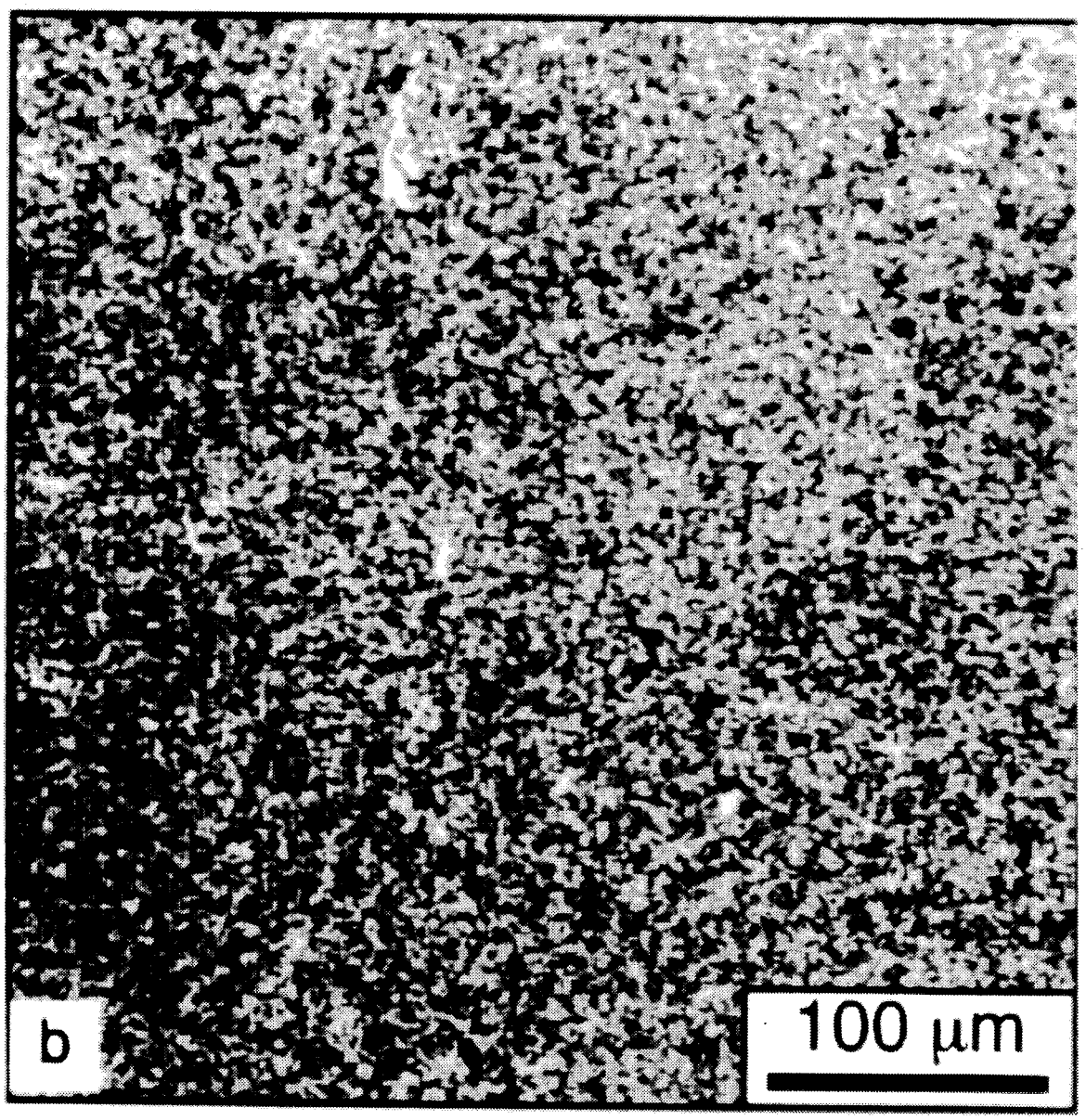
FIG. 2 is a microphotograph of $Al_2O_3$—TiC—$Ni_3Al$ composite fabricated with 1.3 μm TiC powder in accordance with the present invention.
Figure 3:
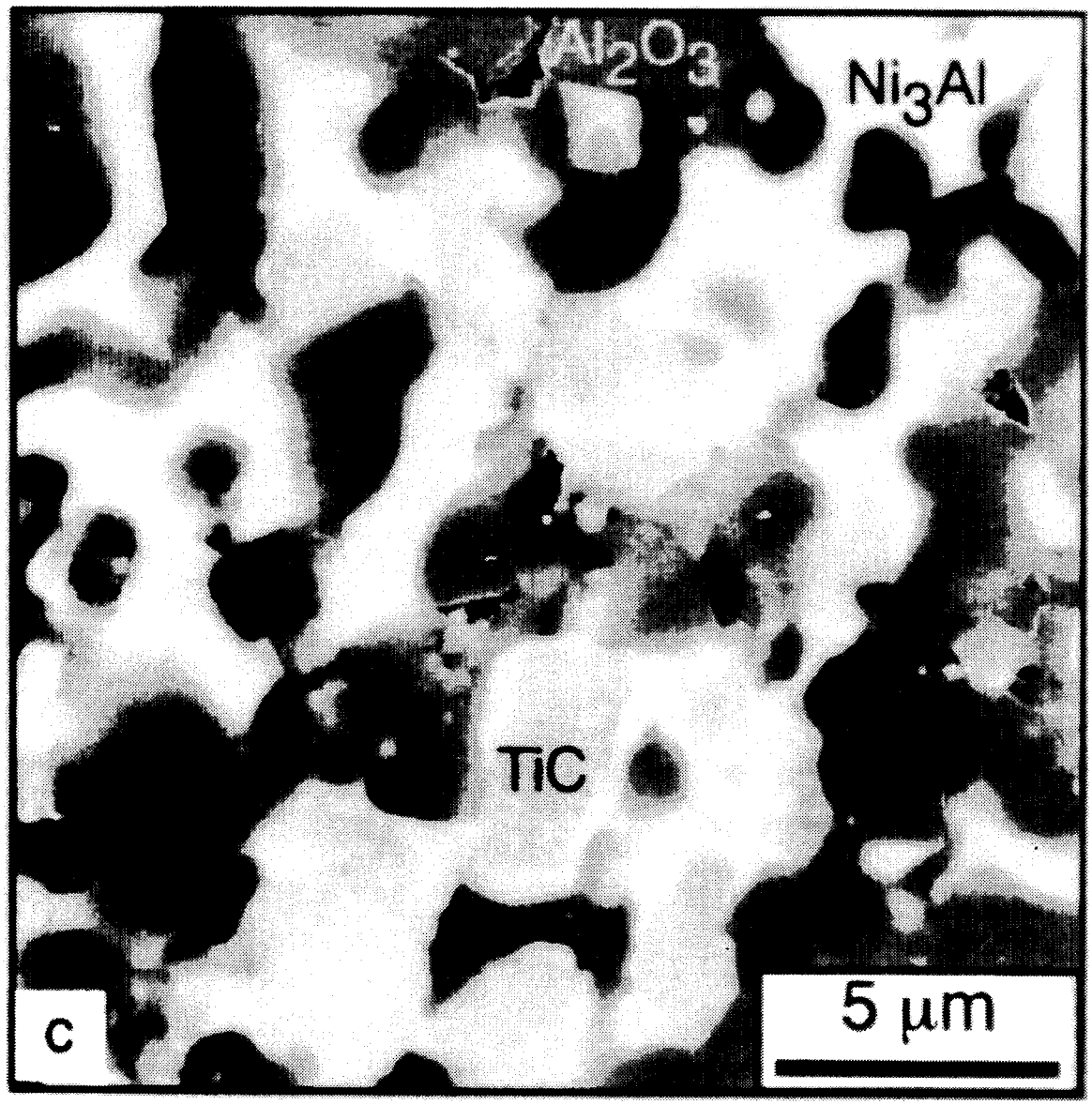
FIG. 3 is a microphotograph of the $Al_2O_3$—TiC—$Ni_3Al$ composite shown in FIG. 1 at 20 times the magnification of FIG. 1.

Shown in FIG. 1 is a microphotograph of 65 $Al_2O_3$/25 TIC/10 $Ni_3Al$ composite fabricated with 3.0 μm TiC powder. The specimen was hot-pressed at 1550° C. with 14 MPa applied pressure. Shown in FIG. 2 is a microphotograph of 65 $Al_2O_3$/25 TiC/10 $Ni_3Al$ composite fabricated with 1.3 μm TiC powder. Specimen hot-pressed at 1550° C. with 28 MPa applied pressure. Shown in FIG. 3 is a microphotograph at a higher magnification view of composite shown of FIG. 1. The lightest phase is the $Ni_3Al$ and the darkest phase is the $Al_2O_3$ as indicated. Shown in FIG. 4 and FIG. 5 are composites of 90 $Al_2O_3$/10 $Ni_3Al$ shown for comparison. Starting $Ni_3Al$ powder size of <45 μm was used in the 90 $Al_2O_3$/10 $Ni_3Al$ composite shown in FIG. 4 and starting $Ni_3Al$ powder size of <38 μm, >15 μm was used in the 90 $Al_2O_3$/10 $Ni_3Al$ composite shown in FIG. 5. All compositions are given in volume-fraction.

TABLE I

Fabrication Conditions and Mechanical Properties of $Al_2O_3$/TiC/$Ni_3Al$ Composites.

| $Al_2O_3$# | TiC## | $Ni_3Al$ | Temp. (°C.) | Pressure (MPa) | Density % T.D. | Hardness+ (GPa) | Toughness MPA√m | Strength (MPa) |
|---|---|---|---|---|---|---|---|---|
| 65 | 25* | 10 | 1550 | 14 | 92 | 18 | 7.14 ± 0.2 | 345 ± 23 |
| 65 | 25 | 10 | 1500 | 14 | 92.5 | | | |
| 65 | 25 | 10 | 1550 | 14 | 95 | | | |
| 65 | 25 | 10 | 1500 | 14 | 96 | | | |
| 65 | 25 | 10 | 1550 | 28 | 97 | 18.3 | 8.06 ± 1.1 | 580 ± 47 |
| 65 | 25* | 10 | 1550 | 28 | 100 | | | |
| 65 | 25 | 10 | 1550 | 28 | 96 | | | |
| 65 | 25 | 10 | 1550 | 28 | 95 | | | |
| 90** | — | 10 | 1350 | 35 | 100 | 14 | 7.6 | 556 |
| 90++ | 10 vol. | SiC whisker | 1750 | 35 | 100 | <19 | 6.2–7.0 | 450 ± 575 |

#All compositions given in volume-percent. Alumina - 3 micron powder.
TiC - 1.3 micron or 3 micron (*) powder.
+Hardness is measured with a 5 kg Vickers indent (VPH). Toughness is measured by indent-and-fracture four-point bend test using a 20 kg. Vickers indent.
**Anisotropic microstructure, toughness reported is for the most favorable orientation of the composite exhibiting the highest flexural strength.
++Typical range of values is given for $Al_2O_3$/SiC whiskers.

TABLE II

Cost comparison of various alumina-based ceramics.*

| Material | Toughness ($K_I$) | Cost ($/kg) |
|---|---|---|
| Alumina | 3 | 45 |
| Alumina 10 vol % SiC whiskers | 4–7 | 74 |
| Alumina 20 vol. % SiC whiskers | 6–8.5 | 105 |
| Alumina 10 vol. % $Ni_3Al$ | 4.5–7.8 | 61 |
| Alumina 20 vol. % $Ni_3Al$ | — | 78 |
| Alumina/25 TiC/10 $Ni_3Al$ | 7–8 | 56 |

*Prices calculated for raw materials only - purchased in approx. 45 kg. quantities.

While there has been shown and described what is at present considered the preferred embodiments of the invention, it will be obvious to those skilled in the art that various changes and modifications may be made therein without departing from the scope of the invention as defined by the appended claims.

What is claimed is:

1. A ceramic composite comprising alumina particulates, titanium carbide particulates, and a ductile binder of nickel aluminide, said titanium carbide particulates being about 25 vol % of said ceramic composite and said ductile binder of nickel aluminide being about 10 vol % of said ceramic composite, said ceramic composite having a fracture toughness equal to or greater than 7 MPa $m^{1/2}$, a hardness equal to or greater than 18 GPa, and said ductile binder of nickel aluminide being isotropically distributed throughout said ceramic composite.

2. An article of manufacture comprising alumina ceramic particulates, titanium carbide particulates, and a ductile binder of nickel aluminide, said titanium carbide particulates being about 25 vol % of said ceramic composite and said ductile binder of nickel aluminide being about 10 vol % of said ceramic composite, said ceramic composite having a fracture toughness equal to or greater than 7 MPa $m^{1/2}$, a hardness equal to or greater than 18 GPa, and said ductile binder of nickel aluminide being isotropically distributed throughout said ceramic composite said article having a density greater than 85% of theoretical density and being in a dense, rigid form.

* * * * *